United States Patent [19]

Cable et al.

[11] 4,389,005

[45] Jun. 21, 1983

[54] INFANT CARRIER

[76] Inventors: Richard B. Cable; Willie D. Cable, both of 3063 Waterdale Dr., Loveland, Colo. 80537

[21] Appl. No.: 260,064

[22] Filed: May 4, 1981

[51] Int. Cl.[3] ..... A47D 13/02

[52] U.S. Cl. ..... 224/159; 224/258

[58] Field of Search ..... 224/155, 159, 160, 161, 224/158, 202, 257, 258; 297/197, 385, 390, 391, 392, 355

[56] References Cited

U.S. PATENT DOCUMENTS

| | | | |
|---|---|---|---|
| 1,060,257 | 4/1913 | Humphrey | 224/202 |
| 1,273,201 | 7/1918 | Teuber | 224/257 X |
| 2,056,925 | 10/1936 | Kimbrough | 224/159 |
| 4,091,974 | 5/1978 | McClintock | 224/257 |

FOREIGN PATENT DOCUMENTS

| | | | |
|---|---|---|---|
| 462938 | 1/1950 | Canada | 224/159 |
| 585378 | 2/1957 | United Kingdom | 224/159 |

*Primary Examiner*—Allan N. Shoap
*Assistant Examiner*—Robert Petrik
*Attorney, Agent, or Firm*—Kyle W. Rost

[57] ABSTRACT

A firm V-shaped saddle is supported from its narrow end by a hip rest having a force disbursion plate thereon of larger surface area than the narrow end of the saddle. Straps from the opposite, wide end of the saddle are connected to rings at the top of the hip rest, and the entire saddle and hip rest are then suspended from the rings by cross-body straps that lead to a shoulder cup having an over-the-shoulder band and an around-the-shoulder band with a central opening receiving the point of the shoulder. The saddle maintains its firmness due to a stiff inner frame of metal or the like with a flexible outer edge angling upwardly and outwardly to retain the infant on the saddle.

14 Claims, 3 Drawing Figures

INFANT CARRIER

BACKGROUND OF THE INVENTION

1. Field of the Invention

The invention relates to article carriers, and specifically to infant carriers. An infant carrier having a seat portion with a shoulder strap extending diagonally across the adult's body is disclosed, wherein the seat has a rigid saddle-like structure.

2. Description of the Prior Art

Infant carriers are well known as means for an adult to transport a child while leaving the adult's hands free for other functions. Carriers also are known for supporting the child at different positions relative to the adult's body, such as on the adult's back, front or side. For example, U.S. Pat. No. 3,197,100 to Thompson discloses a back-pack carrier constructed of flexible material. U.S. Pat. No. 2,599,474 to Mills discloses a front side carrier that fits the adult much like a vest. U.S. Pat. No. 2,846,699 to Watson discloses a portable bed-style infant carrier that is carried against the adult's side.

It has been the practice in the prior art to construct infant carriers of soft, flexible materials so that the child will remain as comfortable as possible during travel. Correspondingly, the carrier is intended to be comfortable for the adult as well. Primarily for the latter reason, carriers have been provided with large, soft straps. In the above referenced Thompson patent, for example, the back-pack style carrier is equipped with a pair of shoulder straps, each of which passes between the wearer's neck and shoulder edge much like the straps of any back-pack. The Mills patent, as previously stated, relates to a vest-like garment and employs a pair of wide straps that pass over the shoulder as would the shoulder of a vest. The Watson device employs a single strap that diagonally crosses the wearer's body and rests between the neck and shoulder edge.

The problems addressed from the prior art are twofold: First, infant comfort is often ill served by use of soft, flexible materials that form a satchel-like carrier. Quite uniformly, the child rests on a cloth sling with his legs dangling free. While such an arrangement appears comfortable at first impression, that area of cloth supporting the child's body is often quite restricted and may constitute narrow creases of cloth crossing the child's crotch. In time, this leads to discomfort and may impair circulation to the child's legs.

Second, the wearer's comfort and posture are negatively influenced by the types of support straps previously identified. Any strap looped around the wearer's neck or shoulder for supporting the carrier from the front or side is likely to cause, in time, back strain, neck strain, and shoulder soreness. The best arrangement from the prior art appears to be the back-pack carrier that distributes the child's weight onto both shoulders, but even this arrangement may result in discomfort since the straps are crossing the soft tissue of the shoulder adjacent to the base of the neck.

The wearer's comfort is also compromised by the flexibility and softness of the carrier, which allows the child's bony frame to rest directly against the adult.

These problems have been addressed in the creation of an infant carrier that is designed to accomodate to orthopedic requirements of both the child and the adult, so that the carrier may relate to both parties to provide necessary support and balance.

SUMMARY OF THE INVENTION

An infant carrier has a saddle-like seat attached to a hip rest that distributes weight applied to the seat over a broad area. The carrier is supported by cross-body straps that are attached to a shoulder cup having an over-the-shoulder band and an around-the-arm band that further divide and distribute the weight of the carrier. The carrier saddle has a V-shaped frame with an arcuate brace connecting the free ends of the V and having support straps connected to the opposite ends thereof. The narrow end of the V is attached to a first plate in the hip rest frame, which in turn is attached to a second, larger plate, and the two plates are firmly joined to the saddle frame.

The main object of the invention is to create an infant carrier that is of improved comfort to the infant. This is accomplished by creation of a firm saddle that extends from one side of a broad hip rest to support the infant. The saddle allows the infant to shift his weight with freedom, as contrasted with sling type carriers in which the infant will naturally settle into the pit of the sling and be unable to effectively move his weight to any other position in the sling.

Another object of the invention is to create an infant carrier that is of improved comfort to the adult wearer. This is accomplished by the dual factors of saddle support on a hip rest and carrier support from cross-body straps leading to a top and side of shoulder support cup. The portion of the carrier weight borne by the wearer's hip is spread over a broad area to dissipate the forces, and the portion of the carrier weight borne by the wearer's shoulder is divided between the top and side of the shoulder, while leaving the arm free to move as necessary.

DESCRIPTION OF THE PREFERRED EMBODIMENT

Figure 1:
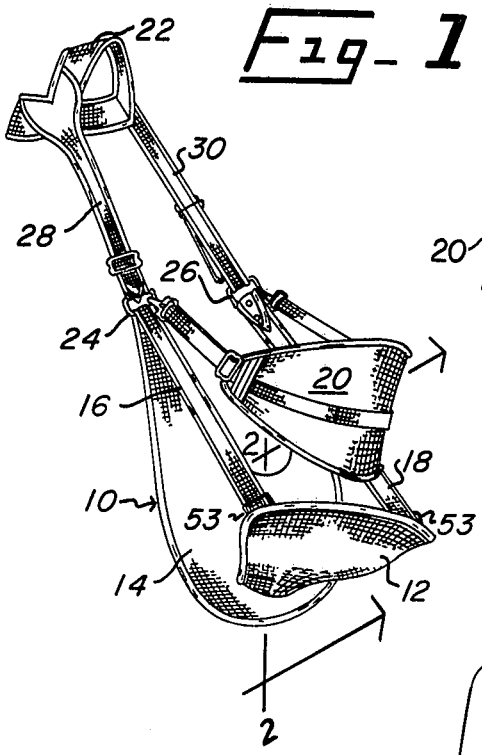
FIG. 1 is an isometric view of the carrier.

The infant carrier 10 is best viewed in its entirety in FIG. 1, wherein the primary parts are seen to be the infant seat or saddle 12, the hip rest 14, saddle support straps 16 and 18, infant back support 20, and shoulder cup 22. The saddle support straps, hip rest, and back support all are connected to suspension rings 24 and 26, and the shoulder cup in turn supports the suspension rings from cross-body straps 28 and 30.

Figure 2:
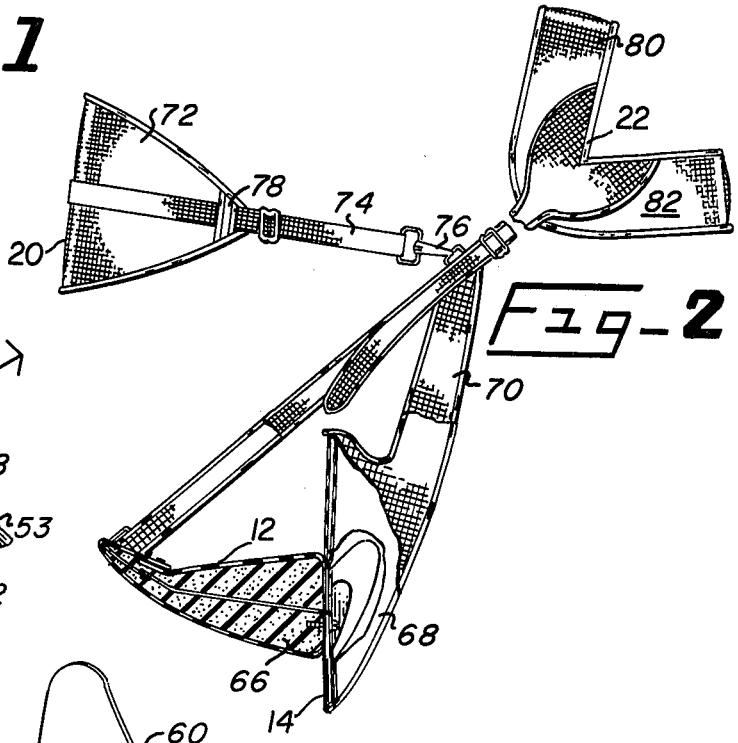
FIG. 2 is a side elevational view of the carrier in partial section through the saddle, hip rest, one saddle support strap, and one hip rest extension strap along the plane of line 2—2 of FIG. 1, as viewed from approximately the rear face of FIG. 1.
Figure 3:
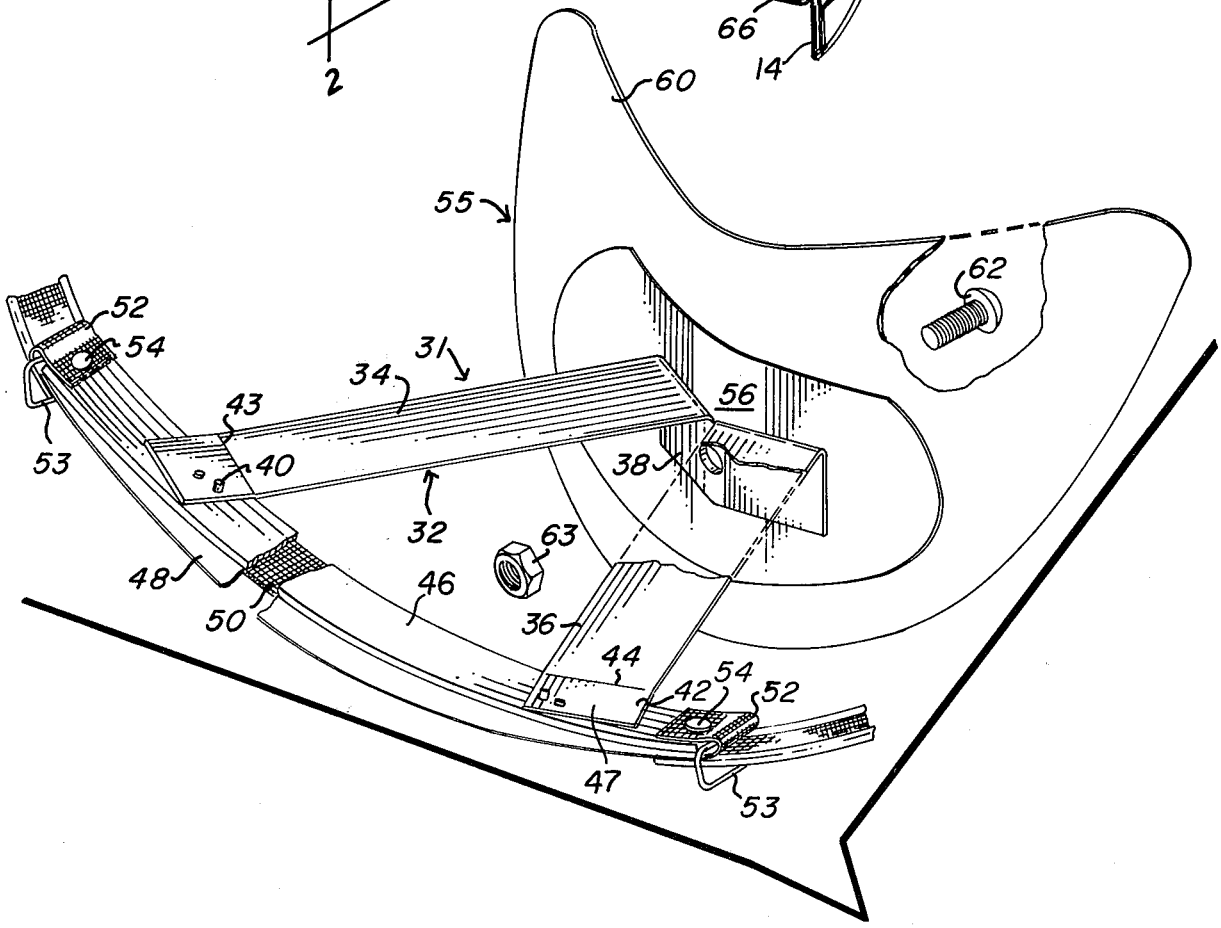
FIG. 3 is an isometric view of the saddle frame and hip rest frame.

The saddle 12 is notable for its stiffness, and, as best shown in FIG. 3, this is the result of stiff support means in the saddle frame 31 supplying the necessary rigidity for supporting a child seated thereon. The longitudinal support member 32 is preferably in the form of a V-shape having arm 34 and arm 36 meeting at the base 38 of the V-shape to form a single tab adapted to be attached to the hip rest. The entire support 32 may be formed from a suitably stiff material such as aluminum, steel, or various synthetics. Base 38 is best at an angle to the plane of arms 34 and 36, which angle may be a right angle with the preferred angle being between 90 degrees and 120 degrees. The base may be viewed in FIG. 2 to be in an approximately vertical position, with the result that the arms 34 and 36 are horizontal or angling upwardly therefrom at an angle that may be as great as 30 degrees or more. The separation between arms 34 and 36 may be preselected to accomodate a desired saddle width, but it is generally preferred that the included angle be between 30 and 60 degrees with the preferred angle being approximately 40 degrees. Base 38 may be bent to create the required angle between arms 34 and 36, allowing the entire member 32 to be constructed from a single rectangle of material having the combined width of arms 34 and 36, which is the same width as base 38; alternatively, a wedge of material may be removed from between the arms to create the desired V-shape and base 38 may remain flat in vertical position; or some metal may be removed and base 38 may also be bent in a combination of the above techniques suitable to control the amount of bending in base 38.

The outer ends 40 and 42 of arms 34 and 36, respectively, are angled upwardly at their respective bend points 43 and 44, for example at 30 degrees to the arms, to create an upward curve at the rear of the saddle. The upwardly bent portions 40 and 42 are then attached to cross brace 46, which is curved in a smooth arc. Brace 46 is preferably constructed of a strong material such as steel or aluminum, and the connection to the arms may be by rivets 47. The brace 46 extends laterally beyond the arm ends 40, 42 for a substantial distance such as one to two inches at each end, creating a considerable lateral space at the sides of the saddle as defined by the ends of the brace and the base of the member 32.

Under brace 46 is attached a sheet 48 of flexible material such as polystyrene or marlex plastic extending longitudinally outwardly from the brace for a distance such as two inches, and the sheet 48 is laterally of equal length with brace 46. The outer edge of sheet 48 is arcuate with the widest portion near the center of brace 46. Underlying sheet 48 is a heavy strap 50 having the same approximate width as brace 46 and extending laterally beyond the end of the brace, then curving back at each end to overlap the ends of the brace, for example for one inch, and forming a loop 52 at each end of the brace. The loops 52 are for the purpose of attaching rings 53, one in each loop. A preferred material for strap 50 is nylon webbing.

Finally, saddle support straps 16 and 18 have their lower ends underlying the strap 50 and the ends of brace 46. Fastening means such as rivets 54 attach the ends of straps 16 and 18, the body and ends of strap 50, sheet 48 and brace 46, holding all of these parts in fixed position. As shown in FIG. 3, rings 53 hang freely from loops 52, and straps 16 and 18 pass through the respective rings but leave sufficient space within the rings for attachment of other straps therethrough.

The structure heretofore described is then connected to the hip frame 55. This may be accomplished by joining the base 38 to a shield-shaped metal plate 56 near the center thereof. The metal plate 56 is substantially larger in surface area than base 38 and serves as means to disburse bending pressures over a wide area. The metal plate 56 is attached to a larger shield-shaped plate 60, which may be constructed of flexible plastic. Base 38, plate 56, and plate 60 may be connected together by fastening means such as bolt 62 and nut 63 passed through a common hole in the various parts. The plates 56 and 60 may be bent or curved to conform to the bend in base 38, and to a larger extent to conform to the hip of the infant carrier wearer. Both plates assist in disbursing local forces generated by weight applied to the saddle and transmitted to base 38.

With reference now to FIG. 2, the saddle frame and hip rest frame are incorporated into the totality of the infant carrier by encasing them in padding and enclosing them in an outer covering. Both the top and bottom of the saddle frame 31 are covered by suitable padding 66, as is the area to the lateral sides of arms 34 and 36. Bolt 62 and nut 63 are not only surrounded by padding, but they are located under member 32 and therefore do not interfere with the comfort of the wearer or the child. Sheet 48 provides flexibility to the outer edge of the saddle for comfort of the carried child and also creates a gentle retaining slope at the outer end of the saddle to prevent the child from sitting too far back. The hip rest frame is covered with padding 68 on both sides thereof to cushion the frame from the child on the saddle side and to cushion the frame from the adult in the wearer side.

The outer covering may be of any suitable material, with a vinyl plastic being the preferred fabric. The saddle is covered in a relatively form fitting manner, while the hip rest is covered in a manner to not only retain padding 68 in place, but also to form strap like extensions 70 that are attached to suspension rings 24 and 26. As previously explained, saddle support straps 16 and 18 are also attached to rings 24 and 26. The saddle will then be understood to have three point support provided by straps 16 and 18 as well as by the connection of base 38 to the hip rest frame, which in turn is directly supported from rings 24 and 26. The saddle cover permits attaching rings 53 to extend openly so that an accessory bag, purse, or the like can be suspended from the saddle at the rear, out of the way of the carried infant.

The infant back support 20 includes a pad member 72 having a strap 74 extending across the pad and having spring clips 76 on the strap ends for attachment to rings 24 and 26. The pad member 72 has retaining loops 78 at each end thereof to engage the strap 74. The strap 74 is provided with length adjustment, as is well known in the art.

The shoulder cup 22 and cross-body straps 28 and 30 enable the wearer to carry the saddle and hip rest with optimum comfort. The shoulder cup consists of an upper band 80 that is intended to pass on top of the wearer's shoulder, and a lower or side band 82 that rests across the wearer's upper arm immediately below the shoulder joint. Together, bands 80 and 82 cooperate to hold the entire shoulder cup in a flexible manner on both the upper and lower side of the shoulder joint. Between the bands is an opening through which the corner of the shoulder may extend, and this opening provides added flexibility to the shoulder cup so that the wearer may move his arm with very little restraint from the cup. The cross-body straps are attached to the cup along the intersection between the two bands and as such result in the cup and straps being symmetrical in total configuration. Both straps 28 and 30 may be adjustable in length, allowing the wearer to position the infant carrier at a desired position relative to the wearer's body.

In use, the infant carrier is worn with the shoulder cup on a selected side of the wearer and the hip rest on the opposite side, with the two cross body straps passing, respectively, in front and behind the wearer's torso. The infant is placed on the saddle with one leg on each side of the saddle and the body facing toward the hip rest. The back support then passes behind the infant. The infant's weight is disbursed over the hip rest area by the above described hip rest frame, and the shoulder cup distributes the weight with a considerable lateral component, as compared to a strictly downward application of weight with the ordinary shoulder strap.

The infant rests on the firm saddle and is supported very much as in a chair. His legs are separated by the narrow end of the saddle, but this of little consequence since the natural position of an infant against an adult body ordinarily encourages an open body position. The basic firmness of the saddle surface permits the infant to shift his weight with considerable freedom, without the requirement that his body be physically lifted from the saddle surface, as is the case with the typical sling type carrier. Accordingly, both the infant and the adult find the carrier to be comfortable.

We claim:

1. An infant carrier, comprising:

(a) a firm saddle for supporting an infant;

(b) a hip rest connected to one end of the saddle and having force disbursion means therein for spreading forces applied through the saddle over a broader area than the connection between the saddle and hip rest;

(c) shoulder support means for suspending the carrier from the body of a wearer; and (d) first strap means connecting the shoulder support means to said hip rest;

(e) wherein said saddle comprises a stiff support member having a narrow end and a wide end, the narrow end being attached to said hip rest and said wide end being opposite therefrom.

2. The infant carrier of claim 1, wherein said stiff support member comprises a pair of arms having a common first end and divergent second ends forming a V-shaped frame, and a cross brace connected to said second ends and extending laterally on each side of the V-shaped frame.

3. The infant carrier of claim 2, wherein each of said arms comprises a first portion extending outwardly from said hip rest at a first predetermined angle, relative to horizontal and a second portion extending outwardly and upwardly at an acute angle from said first portion, the cross brace being attached to the second portion of said arms.

4. The infant carrier of claim 3, further comprising a sheet of flexible, resilient material connected to said cross brace and extending outwardly therefrom.

5. The infant carrier of claim 4, further comprising strap means underlying said cross brace and doubled back at each end thereof to form a ring retaining loop; a ring carried in each loop; and fastening means attaching the strap to the cross brace to close each loop.

6. The infant carrier of claim 1, wherein said hip rest force disbursion means comprises a first plate connected to said firm saddle and having a larger surface area than the connection to the saddle.

7. The infant carrier of claim 6, wherein said hip rest force disbursion means further comprises a second plate having a greater surface area than said first plate and wherein said first plate overlaps the second plate.

8. The infant carrier of claim 7, further comprising means for maintaining fixed alignment between said saddle, first plate and second plate.

9. The infant carrier of claim 1, further comprising second strap means connecting said saddle to said first strap means; wherein said second strap means comprises a pair of straps, each connected at one end to said saddle at the end thereof opposite from that attached to said hip rest, and each connected at the opposite end to said first strap means at the connection of the first strap means and the hip rest.

10. The infant carrier of claim 1, wherein said first strap means comprises a pair of straps having each strap of said pair connected to the hip rest on an opposite side of the saddle.

11. The infant carrier of claim 1, wherein said shoulder support means comprises an upper band adapted to pass, in use, on top of a wearer's shoulder and a side band adapted to rest, in use, across the wearer's arm below the shoulder joint, the upper and side bands meeting at their opposite ends to define a central opening adapted to receive, in use, the corner of the wearer's shoulder and to distribute the infant's weight between the straps with lateral and vertical components.

12. The infant carrier of claim 11, wherein said first strap means comprises a pair of straps, each being connected at one end to the intersection of said side band and upper band.

13. The infant carrier of claim 1, further comprising (a) a pair of attaching rings connected to said hip rest at the upper edge thereof and spaced laterally at opposite sides of the saddle;

(b) a pair of straps connected to said saddle at the end opposite from the hip rest and spaced at opposite lateral sides of said saddle end;

(c) each of said straps extending to one of said attaching rings on the corresponding lateral side of the saddle; and (d) wherein said first strap means comprises a pair of straps, each connected at one end to an opposite one of said attaching rings and connected at the second end to a corresponding lateral side of said shoulder support means.

14. The infant carrier of claim 13, further comprising an elongated infant back support having means at each end thereof for connection to one of said attaching rings.

* * * * *